United States Patent [19]

Hemstock et al.

[11] Patent Number: 4,781,298

[45] Date of Patent: Nov. 1, 1988

[54] PROCESS FOR BENEFICIATING CLAY AT HIGH SOLIDS

[75] Inventors: Glen A. Hemstock, Princeton, N.J.; Mitchell J. Willis, Macon, Ga.

[73] Assignee: Engelhard Corporation, Menlo Park, N.J.

[21] Appl. No.: 938,205

[22] Filed: Dec. 3, 1986

Related U.S. Application Data

[63] Continuation-in-part of Ser. No. 916,149, Oct. 7, 1986, and a continuation-in-part of Ser. No. 900,666, Aug. 27, 1986.

[51] Int. Cl.[4] ..... B03C 1/02

[52] U.S. Cl. ..... 209/3; 209/5; 209/214; 210/695; 210/798

[58] Field of Search ..... 209/3.5, 214, 215, 223.1, 209/228, 232, 225; 210/222, 223, 695, 793, 794, 798; 134/95, 98, 99

[56] References Cited

U.S. PATENT DOCUMENTS

| | | | |
|---|---|---|---|
| 3,326,374 | 6/1967 | Jones | 209/232 |
| 3,424,308 | 1/1969 | Fenske | 209/3 |
| 3,471,011 | 10/1969 | Iannicelli et al. | 209/214 |
| 3,838,773 | 10/1974 | Kolm | 209/223.1 |
| 3,861,934 | 1/1975 | Mallary et al. | 209/5 |
| 3,902,994 | 9/1975 | Maxwell et al. | 209/232 |
| 4,087,004 | 5/1978 | Nott et al. | 209/214 |
| 4,087,358 | 5/1978 | Oder | 209/214 |
| 4,191,591 | 3/1980 | Bender et al. | 209/214 |
| 4,266,982 | 5/1981 | Bender | 209/214 |
| 4,303,204 | 12/1981 | Weston | 209/214 |
| 4,414,116 | 11/1983 | Nolan | 210/695 |

FOREIGN PATENT DOCUMENTS

| | | | |
|---|---|---|---|
| 0131785 | 6/1984 | European Pat. Off. . | |
| 0012723 | 1/1984 | Japan | 210/695 |

*Primary Examiner*—Robert B. Reeves
*Assistant Examiner*—Donald T. Hajec
*Attorney, Agent, or Firm*—Inez L. Moselle

[57] ABSTRACT

A process for the wet processing of kaolin clay which includes a step for physically removing discrete particles of colored impurities by high gradient magnetic separation (HGMS) in which all processing steps including HGMS are carried out with the feed clay slurry at high solids, above 50%, and the magnetically purified clay slurry is also recovered at high solids, above 50%. A feature of the invention is that the HGMS unit is operated in a novel manner such as to avoid the dilution of the magnetically purified clay slurry with water during all stages of HGMS treatment without adverse effect on the yield of magnetically purified clay.

28 Claims, 2 Drawing Sheets

PROCESS FOR BENEFICIATING CLAY AT HIGH SOLIDS

RELATED APPLICATIONS

This application is a continuation-in-part of the copending application of Glen A. Hemstock and Mitchell J. Willis, Ser. No. 916,149 filed Oct. 7, 1986 and a continuation-in-part of copending application of Mitchell J. Willis, Ser. No. 900,666 filed Aug. 27, 1986.

FIELD OF THE INVENTION

This invention relates to the art of wet processing kaolin clay crudes to produce fractionated clay products of improved brightness and reduced content of colored impurities. In particular, the invention relates to such processing in which all of the steps are carried out using dispersed clay slurries having a high concentration of clay (high solids clay slurries).

It is conventional in the art to process kaolin clay crudes by wet methods to produce one or more finer fractions having desired particle size ranges and having higher brightness than the crude clay. A principal use of the resulting clay products is for coating paper.

Generally, wet processing of kaolin clays to produce high quality coating pigments includes the following as essential steps. The crude clay is blunged in water to produce a fluid slurry. Grit (e.g., particles larger then 325 mesh) is removed, leaving a degritted slurry. The degritted slurry is then fractionated, typically in a centrifuge, to recover one or more clay fraction of desired particle size. Commercial paper coating clays normally are produced by wet processing that includes a fractionation step or steps such that the fractionated clay products contain no more than about 0.1% by weight of particles larger than 10 microns (equivalent spherical diameter, e.s.d.), no more than about 3% larger than 5 microns and at least about 80% by weight of particles finer than 2 microns. Filler clays, on the otherhand, may contain much larger amounts of coarser particles and the substantial absence of particles larger than 3 microns is normally not critical. A bleach, usually a hydrosulfite salt, is added to the slurry to bleach the clay. Water must eventually be removed from the slurry to produce either a high solids slurry, usually or slurry having solids content of about 70%, or the bleached clay is spray dried to produce a dry material for shipment. Clay dispersants such as sodium silicate, a condensed phosphate salt, or a polyacrylate salt, or a mixture of dispersants, are present in the slurry during various stages of the operation. The dispersant has the effect of reducing the viscosity of clay-water systems. Thus, a 70% solids slurry of most kaolins will have a solid or semi-solid consistency in the absence of a such a system it will become a fluid. Dispersant is invariably present when the clay is fractionated because effective fractionation of clay into fractions of different particle sizes requires that the slurry be in well dispersed condition.

In addition to the wet processing steps cited above, it is frequently necessary to remove colored impurities from the clay by physical separation means in order to provide refined products having the desired brightness and hue. Froth flotation, selective flocculation of either impurities or clay, or wet magnetic separation of paramagnetic impurities from the clay by high gradient magnetic separation (HGMS) are physical separation methods used by the industry. In the case of the Georgia kaolins, the principal colored impurities that are removed by these means are discrete ferruginous impurities and an iron stained form of titanum dioxide (anatase). Known methods for removing colored impurities from kaolin clays have in common the fact that they are carried out with relatively dilute dispersed suspensions. As an example, froth flotation (Ultraflotation) as described in U.S. Pat. No. 2,990,958, is carried out using dispersed clay pulps containing no more than about 25% solids and the flotation beneficiated clay is recovered at solids levels well below 20%. The flotation process known as TREP operates at higher solids. See U.S. Pat. No. 4,492,628. Selective flocculation processing is also carried out with dilute clay slurries. To the best of our knowledge, wet magnetic separation of colored impurities from kaolin clays by HGMS is conducted with clay slurries having a solids content below 40%, typically 20 to 30%. U.S. Pat. No. 3,471,011 discloses that the effectiveness of wet magnetic purification of kaolin clay is impaired when solids increase from 20 to 40% and that it is desirable to heat the feed slurry to the magnet if 40% solids slurries are used.

Wet processing of kaolin clay is carried out on a vast scale in the state of Georgia. The volume of water that is used by the kaolin industry is enormous because of the practice of operating with dilute clay-water systems. The refined fractionated clays are delivered to the users, such as the paper industry, in the form of products that have relatively low water contents (the 70% solid slurry or the spray dried beads mentioned above.) Large quantities of processing water must therefore be removed and be disposed of in an environmentally acceptable manner. A portion of the water in conventionally wet processed clay is removed by filtering acid flocced clay pulps. Filtration can be a relatively inexpensive method for removing water as compared to thermal means. However, filtration requires a substantial capital investment and can be a bottleneck in plant capacity. Thermal means for removing water are becoming increasingly costly. Also, acid flocced cakes must usually be well washed with water to remove by product salts in order to provide kaolin pigments having suitable viscosity.

In order to cope with the expense of water removal and disposal, the kaolin clay industry has in recent years been taking steps to increase the solids at which they carry out wet processing steps. To be of economic significance high solids processing should result in slurries of beneficiated clay having a clay solids content not less than 50%, preferably above 50%, most preferably above 55%. This can present minimal difficulty in the case of blunging, degritting, fractionation and is even feasible during bleaching even though all of these steps result in some dilution. However, it presents formidable problems when one attempts to include means to physically remove colored impurities from the clay by known physical separation technology and also provide clay pigments having usable viscosity. Thus, it is old in the art to blunge, degrit, fractionate and bleach kaolin clay at high solids. To the best of our knowledge, however, the only reported method of physically removing colored impurities in a high solids processing of which we are aware is a specific type of centrifugation procedure described in U.S. Pat. No. 4,018,673. Data in the patent indicate however, that there was minimal improvement in brightness and that the level of removal of iron and titanium dioxides was very small.

HGMS, as currently practiced in the clay industry, utilizes separators of the type in which a stainless steel wool matrix is housed in a canister which is surrounded by a heavy return frame to confine the magnetic flux. HGMS is frequently referred to as HIMS. The slurry of impure clay flows upwardly through the matrix on a continuous basis until the matrix has captured a predetermined amount of paramagnetic impurities. Residual clay is removed from the canister by displacement with water and the stainless steel matrix is deenergized before captured impurities are removed from the matrix by flushing with water. These cycles are repeated.

An inherent characteristic of wet magnetic separation as presently practiced is that the magnetically beneficiated slurry undergoes substantial dilution with water during the magnetic treatment. Dilution occurs both when the residual clay slurry in the canister is displaced with water and when residual flush water dilutes the incoming charge of feed slurry. Consequently, even if it were feasible to charge a wet magnetic separator operated under conditions conventional to the industry with a dispersed slurry containing 70% solids, which it is not, the magnetically purified slurry would be recovered at much lower solids. As a practical matter, however, dispersed slurries at 70% solids, including slurries formulated with dispersant in amount such as to achieve minimum viscosity, are too viscous for use in HGMS units with stainless steel matrices. Using state of the art technology, a 60% solids slurry could be charged to a HGMS unit but it will provide products at much lower solids. Examples of other patents relating to the operation of HGMS separators are U.S. Pat. Nos. 3,819,518, 4,087,358 and 4,281,799. Patents describing magnetic separators using both liquid and gasous media for cleaning are U.S. Pat. Nos. 3,326,374, 4,266,982, 4,191,591 and 4,087,358.

Another reference relating to high solids processing of kaolin clay is U.S. Pat. No. 4,186,027. This patent teaches that kaolin clay can be bleached at high solid levels of 60 to 75% with a dithionite (hydrosulfite) bleach under alkaline pH conditions in the presence of phosphate ions. The patent does not teach any means to physically remove color impurities from kaolin clay and, therefore, will not provide clay products of desired brightness from clay that does not respond adequately to bleaching. Also, data in the patent show that the fractionated clay contains high levels (2–3%) of particles larger than 10 microns. European patent application No. 131,785 also relates to processing of kaolin clay at high solids to produce filler clay. The crude is blunged and dispersed to form a high solids slurry having an acidic pH. The slurry is degritted and bleached at an alkaline pH to produce a treated suspension having a solids content of at least 65%, low grit, acid pH and brightness of at least 84. No removal of colored impurities is practiced. U.S. Pat. No. 4,618,374 discloses a process for producing filler clay from a poor grade crude by a high solids process including blunging, degritting, fractionation to 92–95% finer than 2 microns, bleaching with a reducing agent to produce a leached suspension having a solids content of at least 55%; the process features the treatment of the leached suspension with an oxidizing agent to oxidize unreacted leaching agent and byproducts.

U.S. Pat. No. 4,018,673 to R. E. Hughes et al discloses centrifugation of a dispersed high-solids clay suspension (up to 70–72% solids) to remove quartz, iron compounds, titanium oxide and other impurities. The patentee discloses (column 3, line 54 et seq) over-dispersing the clay by adding up to about 20% excess dispersant over that needed to obtain the minimum viscosity. The stated reason (column 3, line 67 et seq) is that the phosphate-type dispersants utilize tend to degrade in the suspension on standing.

SUMMARY OF THE INVENTION

This invention provides a novel process for the wet processing of kaolin clay which includes a step for physically removing discrete particles of colored impurities by high gradient magnetic separation (HGMS) in which all processing steps including HGMS are carried out with the feed clay slurry at high solids, above 50%, and the magnetically purified clay slurry is also recovered at high solids, above 50%. A feature of the invention is that the HGMS unit is operated in a novel manner such as to minimize the dilution of the magnetically purified clay slurry with water during all stages of HGMS treatment without adverse effect on the yield of magnetically purified clay. As mentioned above, dilution of magnetically purified clay slurries has been inherent in the operation of HGMS units prior to this invention and has precluded the use of magnetic purification in prior art schemes for the high solids wet processing of kaolin clay.

Kaolins dilution is avoided, in accordance with the present invention, by controlled injection of a gas stream, preferably air, into the magnetic separator both to displace retained clay slurry in the magnet prior to introduction of water to flush impurities from the magnet and to displace the subsequently introduced flush water prior to introducing new incoming charge of feed slurry. The first gas purge is applied when the magnet is energized, whereby residual clay slurry in the canister is selectively removed from the unit with minimal rejection of impurities which are retained in the matrix of the HGMS unit. During the second gas purge the magnet is deenergized, whereby impurities held in the matrix of the separator are removed. Both gas purges are carried out by passing gas downwardly through the matrix using controlled gas pressure. Gas pressure is controlled to minimize two-phase flow (water hammer) in order to prevent damage to the matrix. The separators are operated with feed passed upwardly through the matrix.

Operation of HGMS unit in the novel manner described above, is described in said copending application "PROCESS FOR REMOVING MAGNETIC PARTICLES FROM A SUSPENSION OF SOLIDS IN A LIQUID", filed in the name of Mitchell J. Willis. We believe that the improved process for operating a HGMS unit as described in this copending application is a major innovation in the operation of such units because it affords for the first time means to effectively purify clay while affording outstanding recovery of clay with minimal dilution. Note that U.S. Pat. No. 4,087,358 discloses an operation of a magnet of the HGMS type in which air is used to displace flush liquid as an optional step. However, this patent focuses primarily on providing improved means for flushing collected impurities from the separator. The patent does not teach, mention or suggest that a stream of gas could be used to displace clay slurry from the canister before the magnet is deenergized. To the contrary, the patent teaches the application of auxiliary mechanical forces to dislodge the retained magnetics and thus leads away from the invention.

In a preferred embodiment of the invention, the clay feed to the HGMS unit contains a higher level of dispersant than is required to produce a dispersed slurry of clay that has minimum Brookfield viscosity. Note that it is conventional in many clay processes to operate with clay slurries having minimum viscosity.

One aspect of the invention comprises wet processing clay using the following an essential steps. The crude kaolin clay is first blunged in water, preferably in the presence of a dispersant, at high solids, above 55%, preferably above 60%, and most preferably at about 68 to 72% solids, and typically at 70% solids. The slurry of blunged clay is then degritted to remove coarse oversize by means well known in the art and is optionally fractionated by centrifugation or gravity to recover one or more fractions of degritted fractionated clay containing the desired concentration of particles finer than 2 microns equivalent spherical diameter (e.s.d). The aqueous clay slurry is in dispersed state throughout these steps. The recovered fine particle size fraction(s) of clay may be, for example, a No. 2 coating clay fraction which is about 80% by weight finer than 2 microns (e.s.d.) or a No. 1 coating clay grade which is about 90% finer than 2 microns (e.s.d.). The dispersed slurry of coating clay fraction is recovered. A secondary quantity of dispersant is then preferably added to the fraction to assure that the slurry is an overdispersed state when it is charged to the magnet unless the slurry is already overdispersed. Especially preferred for achieving overdispersion is to introduce an alkali metal polyacrylate salt, such as sodium polyacrylate, to the clay to achieve minimum Brookfield viscosity and then add a predetermined quantity of noted dispersant or alkali such as soda ash or caustic soda until pH rises and Brookfield viscosity undergoes a dramatic increase. The overdispersed, fractionated aqueous clay slurry is then charged to HGMS unit containing a matrix of stainless steel wool which is housed in a canister. The slurry is passed upwardly through the matrix while applying a sufficiently strong magnetic field to the matrix to set up regions of high gradient in the matrix. After a suitable period of time, passage of the slurry through the matrix is discontinued. While continuing to apply the magnetic field to the matrix, a stream of pressurized air is passed downwardly through the matrix to displace retained clay suspension which is recovered. The matrix at this point is laden with paramagnetic impurities. These are removed by passing flush water upwardly, downwardly or both through the matrix while deenergizing the matrix. Retained flush water is removed by passing a stream of pressurized air downwardly through the matrix to displace the retain flush water. The magnet operation is carried out on a semicontinuous basis. After retained flush water is removed, the clay slurry is charged to the magnet. This clay slurry can be composed of clay which has not previously been charged to the magnetic separator or it can be composed in whole or in part of recycle slurry (slurry that has previously undergone magnetic purification).

The dispersed slurry of magnetically purified clay is then optionally bleached with a reducing bleach, preferably a dithionite (hydrosulfite) salt, without flocculating and filtering the slurry prior to or subsequently to bleaching, thus avoiding filtration steps. The dispersed brightened clay product, which has a solids content of at least 55% is then dried or formed into a high solids slurry for shipment. Dry clay can be added to the slurry of beneficiated clay to build up solids to produce slurries having a solids content of the order of 70%. Alternatively, thermal evaporation can be employed to increase solids to a high level desired for shipment. It may be desirable to buildup solids by adding dry clay which imparts desired rheological or other properties such as enhanced brightness. For example hard kaolin can be added to slurries of beneficiated slurries of soft clay to improve rheology.

Most preferably, the process of the invention is carried out without introducing soluble salts other than dispersants and while avoiding thickening, filtration and washing steps which are required in conventional kaolin processing to minimize the level of soluble salts which are detrimental to clay viscosity. Deleterious soluble salts are introduced when dispersed slurries are flocculated with acid, usually sulfuric alum or combinations of acid and alum, forming undesired sulfate salts which must be removed by washing filter cakes. In the process of the invention, all steps are carried out at high solids. Floccing is not practiced. By-product salts are not formed. When bleaching is not practiced, no salts other than dispersants are introduced during production.

The practice of the present invention, by using a pressurized gas to displace retained suspension from a matrix, and recovering the displaced suspension, and preferably also using a pressurized gas to displace flush liquid from the matrix, reduces or minimizes dilution of the magnetically-treated product. This aspect alone provides four distinct advantages, as follows. (1) The yield of the wet magnetic treatment is improved because the gas-displaced suspension is recovered, whereas the prior art must sewer the flush water-displaced suspension, because it is so highly diluted. (2) A final product of higher solids content is obtained, which eliminates or reduces the cost of downstream dewatering needed to attain a desired final product solids content. (3) In those cases in which the recovered displaced suspension is recycled through the magnetic separator, purity of the magnetically treated product is increased because some of the suspension is treated twice. (4) Operation of the wet magnetic separation system can be simplified and automated, instead of having to rely on operator skill and know-how. In addition to the foregoing advantages, by maintaining at all times during treatment of the clay a high-solids content, the volume of suspension per unit weight of clay which must be handled and transported is significantly reduced with concomitant savings in plant equipment and operating costs. These advantages are discussed more fully below in the Detailed Description of the Preferred Embodiments.

While broadly applicable to the removal of magnetically attractable particles contained in a clay suspension, the present invention is well adapted for use in operations in which the material to be treated is an aqueous suspension of kaolin clay particles containing magnetically attractable impurities, such as clay colorant impurities naturally occurring in the clay, e.g., one or more of iron, titanium and their oxides. The flush liquid may be water and the pressurized gas may be air.

DETAILED DESCRIPTION OF THE PREFERRED EMBODIMENTS

Figure 1:
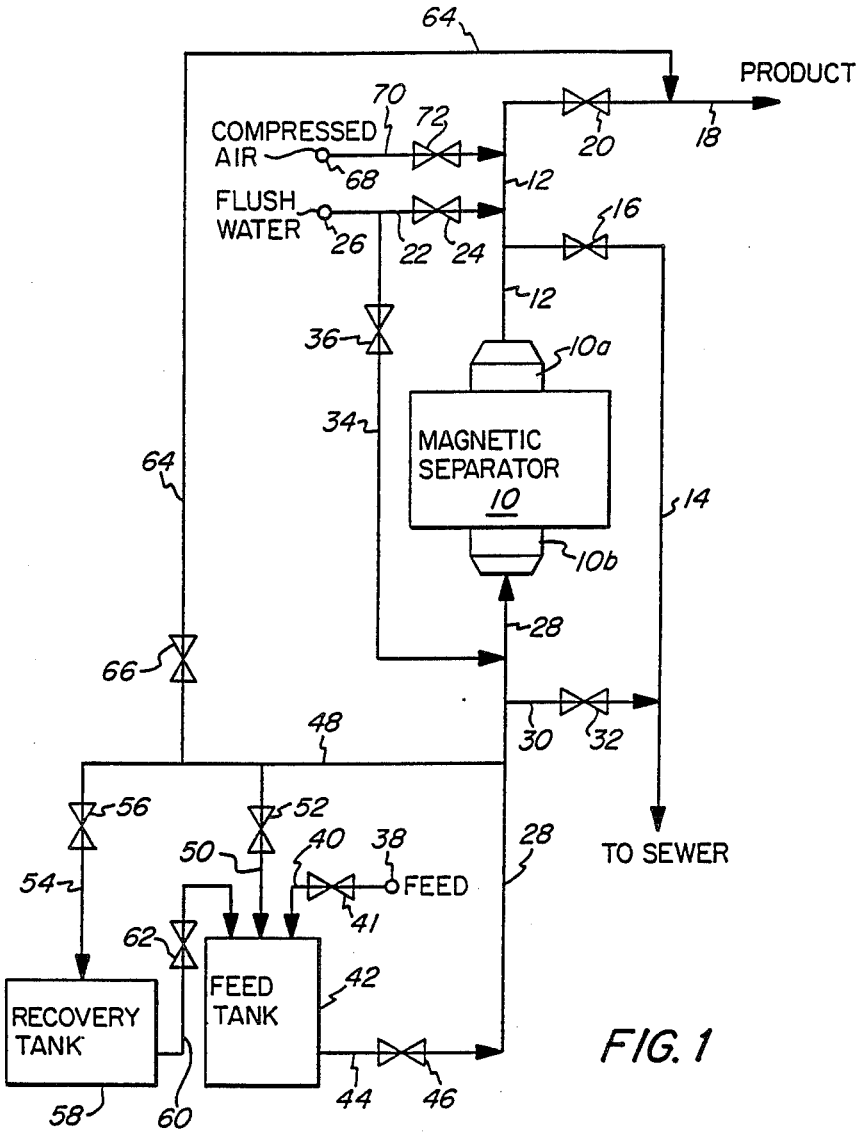
FIG. 1 is a simplified, schematic block diagram of a system for removing magnetic impurities from a liquid suspension or slurry, in accordance with one embodiment of the process of the present invention.

The present invention provides for wet processing of high-solids suspensions of clay particles in a liquid vehicle, including wet magnetic separation of the high-solids suspension. As indicated by the above-mentioned copending and Commonly Owned patent application, the benefits of minimizing dilution of the clay suspension in the course of the wet magnetic separation, as provided by the present invention, are even greater for high-solids suspensions than for low-solids suspensions. Low-solids levels conventionally used in the industry are 25% to 35% solids and a solids level of 50% or higher is generally considered a high-solids clay suspension. The present invention thus discloses a process for wet processing clay at high solids which results in a beneficiated clay product also having a high-solids content. As disclosed in detail herein, all the clay processing steps including wet magnetic separation are carried out at an increased solids content as compared to prior art wet magnetic separation processes. The processing is thus carried out at a solids level of at least 50% solids, e.g., a high-solids content, of at least about 55% solids and higher, e.g., at least about 60% solids. The processing steps may include blunging the crude clay, fractionating the blunged clay to provide one or more fractions of clay of desired particle size, physical removal of the colorant impurities by wet magnetic separation and, optionally but preferably, bleaching. This entire course of treatment is carried out on a high-solids suspension of the clay, typically a high-solids suspension of kaolin clay particles. The techniques of the present invention enable efficient wet magnetic separator brightening treatment of high-solids suspensions.

The brightened beneficiated clay product produced by the process of the present invention is obtained as a dispersed aqueous suspension having a solids level which, ideally, is lowered as little as possible from that of the feed suspension to the initial processing steps. It will be readily apparent to those skilled in the art that the present invention is of especial significance in such a scheme for high-solids processing, or for other conceivable schemes for beneficiating kaolin clay, in which the clay feed suspension to the wet magnetic separator has a high-solids content which, to the extent possible, should be maintained in the magnetically purified clay suspension product.

The wet processing of crude clays typically includes blunging the crude clay at high-solids levels, which for some clays may be maintained as high as in excess of 70% solids, e.g., 72% solids, by using organic dispersants. Solids levels of at least about 68% can be maintained for aqueous dispersions of most clays, by use of suitable dispersants. Thus, the crude clay may be slurried and dispersed, by suitable dispersant chemicals, in water to form an aqueous suspension which may be pumped at, say, 65% or higher solids, to the treatment plant. (Unless otherwise specified, reference herein and in the claims to percent solids of a clay suspension refers to the precent by weight of clay solids, on a dry basis, in the suspension or other composition. Thus, a 65% solids aqueous clay suspension means that 65% by weight of the suspension is comprised of clay solids, on a dry basis. Blunging may be carried out in a suitable mixer or series of mixers and in the preferred practices of the present invention, an energy input of about 15 to 20 Horsepower per short ton (dry basis) of clay is employed in the blunging operation. Conventional means such as drag boxes or screening devices can be used to degrit the clay suspension. This is followed about by centrifugation to recover fine particles size clay fractions, the particle of which are typically of a size such that at least 60% by weight, more usually at least 80% by weight of the clay particles are finer than 2 microns equivalent spherical diameter. The dispersed clay may then be treated to reduce impurities and increase brightness by the magnetic separation process of the present invention. The clay may be sold as a high-solids aqueous suspension, or spray dried to provide a pulverulent clay product.

The carrying out of wet magnetic separation of magnetically attractable particles from a high-solids clay suspension or one containing more than about 50% solids presents certain difficulties and problems which are not encountered in similar processing of low-solids (e.g., 25%–35% solids) clay suspensions. With respect to treating a given quantity of clay, the volume of the high-solids suspension to be handled is of course reduced relative to the volume of a suspension lower in solids, but on the other hand the viscosity of the high-solids suspension is higher so that increased resistance to flow of the suspension through the porous matrix is encountered. In addition to the increased energy requirements to pump the more highly viscous material, the higher density of particles per unit volume of suspension increases the difficulty of removing and retaining the attractable impurities.

Generally, it has been found that wet magnetic separation of high-solids clay suspensions is enhanced by avoiding the use of phosphates, which may have an adverse effect on product rheology and may increase viscosity of the suspension. Although silicate dispersants are useable, it is preferred to utilize an alkaline organic dispersant, preferably a polyacrylate/sodium hydroxide dispersant, as such dispersants appear to promote better brightening results in the wet magnetic separation treatment of the clay. Typically, the dispersant may comprise 3.5 parts by weight sodium polyacrylate and 1.0 part by weight NaOH and is used in quantities of 2½ to 3 lbs. of dispersant per ton of clay (dry basis) or more, up to about 5 lbs. of dispersant per ton of clay. The amount of dispersant required depends on a number of factors, including the percent solids of the suspension and the type of clay being dispersed.

It has further been found that the effectiveness of wet magnetic separation of a high-solids clay dispersion in enhancing brightness by the removal of magnetically attractable impurities is enhanced by over-dispersing the clay, as explained more fully above. The degree of dispersal is determined by measurements of both high shear and low shear viscosities of the clay suspension.

In preparing suspensions for measurement of high shear (Hercules) and low shear (Brookfield) viscosity, procedure PL-1 of Engelhard Corporation, the assignee of this application, was used. Brookfield viscosity was measured using TAPPI procedure T648 om-81 at 20 rpm, using the #1 or #2 spindle or at 100 rpm using the #3 spindle. All supensions were formulated with the optimum amount of dispersant, as determined by following procedure PL-3 of Engelhard Corporation. The Engelhard Corporation PL-1 and PL-3 procedures are as follows.

Procedure PL-1

This procedure is a standard laboratory makedown method for the makedown of hydrous clays at 70% solids under high shear conditions. Hydrous clays may also be madedown at other solids levels, such as 68% for delaminated clays by utilizing this procedure and correspondingly adjusting the amount of water used.

Equipment and Material

| | |
|---|---|
| Analytical balance | 1000 ml and 600 ml |
| Aluminum tins for weighing | unbreakable beakers |
| Electric, forced air oven | Oven dry mineral (clay) |
| Laboratory balance, accuracy ± 0.1 grams | Deionized water |
| | Dispersant (as required) |
| Waring Blendor ® mixer (belt driven by ¾ HP motor, with pulley to provide 10,500 rpm) | |

Procedure for Preparation of 70% Solids Clay Slurry

A. Formulation for 70% solids clay slurry

| | |
|---|---|
| Deionized water | 214.0 gms |
| Mineral | 500.0 gms (oven dry basis) |
| Total | 714.0 gms |

B. Determine the moisture content of the mineral to be used by drying a 3 gram sample in the oven for 30 minutes at 220° F. and cooling in a dessicator for 15 minutes before reweighing.

C. Place sufficient distilled water in the Waring Blendor® to provide, together with the moisture in 500 grams of clay (as measured in Step B.), a total of 214 grams of water. If a dispersant is to be used, add it to the water and mix in the Waring Blendor® mixer for 30 seconds.

D. Weigh the oven dry equivalent of 500 grams of clay into a tared beaker. Add the weighed quantity of clay to the water using a small scoop. After the addition of each scoop of clay to the water, "jog" the switch on the motor "off" and "on" momentarily to disperse the clay into the water. Do not allow the motor to attain full speed during the incorporation of the clay into the water. Only allow the blender to come to full speed after all the dry clay has been added. Excessive additional shear on the clay/water slip (particularly in the case of delaminated clays) will effect the reproducibility of rheological measurements on a given sample.

E. When all the clay has been added to the water, scrape the clay on the sides of the blender into the slurry with a spatula, and let the slip mix under full agitation for 60 seconds.

F. Transfer the slip to a tared 600 ml unbreakable beaker and cap tightly to prevent evaporation of water. (Aluminum foil provides a good "capping" material.)

G. Cool the clay slip to 80° F. and determine the final solids content. The solids should be within±0.2% or adjustment is necessary. Adjustment can be made if the percent solids is too high by the addition of water. However, if the percent solids is too low, the slip will have to be discarded and a new one made.

Procedure PL-3

This procedure determines optimum dispersion by making small additions of dispersant to an aqueous clay suspension, mixing and then determining the Hercules and Brookfield viscosity of the suspension. The dispersant level prior to the dispersant addition which causes an increase in viscosity (makes the viscosity poorer) is the optimum dispersant level. The optimum dispersant level for Hercules viscosity may be different from the optimum dispersant level for Brookfield viscosity and, therefore, optimum dispersant levels for Hercules or Brookfield viscosities should be specified.

Equipment

| | |
|---|---|
| Modified Waring Blendor ® (belt drives by ¾ HP motor, with pulley to provide 10,500 rpm) | |
| Hercules Viscometer | Pigment (500 oven dried grams or 250 grams for calcined clay) |
| Brookfield Viscometer | |
| Talboy variable speed mixer | |
| Constant temperature bath | Dispersant (inorganic or organic) |
| Laboratory balance (0–10 grams) | Electric, forced air oven at 105 ± 3° C. |
| Deionized water | |

Procedure

A. Prepare an aqueous suspension of hydrous kaolin by Procedure PL-1 (supra). Add no dispersant for predispersed clay and a minimum amount (about 0.2%) of dispersant (as percent by weight of dry solids weight of clay) for pulverized clay.

B. Determine the percent solids of the sample by drying part of the sample in an oven. Solids should be 70±0.2% for hydrous clay, 68±0.2% for delaminated clay, 50±0.2% for calcined clay and other solids as required.

C. Determine the Brookfield viscosity and Hercules viscosity of the sample.

D. While mixing the sample using the Talboy mixer, add 0.05% dispersant based on pigment weight and continue mixing for five minutes.

E. Determine the Brookfield viscosity and Hercules viscosity.

F. Repeat Steps D. and E. until the viscosity increases (becomes poorer) or stays unchanged after the incremental addition of dispersant.

G. Optimum dispersion is attained by adding the cumulative amount of dispersant which was added before the viscosity increases or there is no viscosity change. The solids, dispersant level and Brookfield and Hercules viscosity are reported at optimum viscosity.

Hercules Viscometer

Hercules viscosity values reported herein were measured with Hercules Hi-Lo Shear Viscometers, Model ET-24-6. These instruments are equipped with a cup to contain the sample fluid and are supplied with a series of rotating bobs and spring sets which provide a variety of shear rate conditions. The Hercules viscometer was equipped with the "A" bob and was employed to operate with the 100,000 dyne cm/cm spring up to 1100 rpm. The "A" bob has the following characteristics:

| Bob Height | Bob Radius | Cup-Bob Clearance | S Value | Max. Shear Rate @ 4400 rpm | Shear Rate Factor (Factor × rpm = Shear Rate) |
|---|---|---|---|---|---|
| 5.0 cm | 1.95 cm | 0.05 cm | 0.00020 | 18196 sec.[1] | 4.14 |

TAPPI Procedure T648 om-81 gives further description of the procedures used to measure high shear viscosity. It is common to report high shear viscosity of clay-water as either dyne-cm$\times 10^5$ torque at 1100 rpm bob speed or as bob speed in rpm at which the maximum torque of $16\times10^5$ dyne-cm was obtained.

Viscometers were operated in the manner summarized below:

1. Set the graph and pen in place on the recording drum (pen is placed on origin on graph paper).
2. Remove the cup and bob from he water bath at 80° F. and dry.
3. Pour $28\pm2$ cc of the fluid to be tested into the cup and set in place on the viscometer. Use of a syringe will frequently facilitate filling the cup.
4. Attach the bob by rotating it counter-clockwise making it only finger tight, then immerse it in the fluid cup to its limit. The fluid should come up to the top of the bob. If not, then more fluid must be added until it covers the bob.
5. Start the viscometer motor (lower left front of viscometer).
6. Press the "AUTO" switch on the control panel. The pen will proceed to draw a graph of shear rate versus shear force (torque). If the viscometer reaches its maximum rpm setpoint, the pen will automatically return to its starting point. However, if the pen goes beyond the maximum allowable torque before reaching maximum rpm, the viscometer will automatically shutdown and the recording drum will have to be returned to its original position using the crank handle.

The precision is based on a dyne-cm$\times10^5$ reading at 1100 rpm and rpm reading at 16 dyne-cm$\times10^5$. The 95% confidence level for the precision for three operations at two different viscosities follows:

| Average | Precision |
|---|---|
| 4.4 dyne-cm $\times$ $10^5$ at 1100 rpm | 16.8% |
| 500 rpm at 16 dyne-cm $\times$ $10^5$ | 21.4% |

The viscosities reported in the Examples given below were measured in accordance with the above-described procedures. However, before presenting these Examples, it will be helpful to illustrate the practice of the invention with respect to a specific embodiment thereof illustrated by the schematic and simplified flow sheet of FIG. 1.

Referring now to FIG. 1, it is to be understood that for the sake of simplicity the schematic illustration omits numerous necessary and conventional items, such as pumps, bleed lines, controls and the like, the use of which is well known to those skilled in the art and the description of which is not necessary for explaining the present invention. A magnetic separator is schematically indicated at 10 and may be a conventional canister-type design wherein a porous, ferromagnetic matrix comprising a body of stainless steel wool is confined within a vertical, enclosed canister of generally cylindrical configuration. The canister is surrounded by an electromagnetic coil, ferromagnetic pole caps, and a ferromagnetic frame surrounding the coil and the canister. Such type of magnetic separator will have a suitable power supply means connected to it by suitable circuitry to generate a magnetic field intensity sufficient to magnetize weakly magnetizeable particles contained in a liquid suspension, e.g., an aqueous slurry of clay particles, passed through it. Alternatively, there may be used any other suitable configuration of magnetic separator having a magnetizeable collector, e.g., a porous ferromagnetic mass on which magnetic impurities are collected under the influence of the applied magnetic field. As used herein and in the claims, a "porous" matrix means one through which a suspension of fine particulate solids in a liquid vehicle, such as a suspension of fine clay particles in water, can be passed and which tends to retain such suspension within the interstitial spaces of the matrix after discontinuation of passing of the suspension therethrough, the retained suspension draining but slowly and incompletely from the matrix. For example, as described in more detail below, a commercially available form of porous matrix comprises a stainless steel wool pad, the filaments of steel being packed within the canister to a density such that about 92% to 96% of the volume of the pad comprises interstitial voids, the steel filaments occupying only about 4% to 8% of the volume of the pad. Such porous matrices, having considerable interstitial void volume, act somewhat in the nature of a sponge, in that they tend to retain the liquid, e.g., water, or the suspension therein for at least a time after cessation of pumping or otherwise passing the suspension or liquid therethrough.

The present invention, which provides for displacing such retained suspension from the matrix with a pressurized gas, is generally applicable to any useful set of process conditions. Typically, the magnetic separator equipment is operated at a magnetic field intensity of about 5 to 30 kilogauss, say about 8.5 to 20 kilogauss, e.g., about 16 kilogauss. Superconducting magnets operate at higher field strength, typically at 50 kilogauss or higher. It is within the scope of this invention to utilize a magnetic separator of the superconducting type which includes a porous matrix, e.g., a stainless steel matrix. The pressurized gas, e.g., compressed air, is used to displace retained suspension and retained flush water, from the porous matrix.

The gas pressure must be administered in a controlled fashion such that the liquid head (which results from the elevation of the canister of the magnet and the vessel to which the product is being purged) must be overcome. Both static and dynamic pressure drop must be accounted for in such a manner that displaced product slurry is maintained in a laminar flow regime. Design of the system, accounting for the total calculated air pressure in this manner, will assure an essential plug flow displacement of product from the matrix, thus avoiding water hammer which, if it occurred, could result in potential damage to the matrix. In the process equipment used in the accompanying illustrative examples, the pressurized gas, compressed air, was maintained at a range of pressure between 8 to 18 psig, preferably, 10 to 15 psig and ideally 13 psig. At these pressures of compressed air, reasonably rapid displacement of retained suspension was attained without dislodgment into the suspension of collected impurities from the matrix, or at least without an unacceptably high degree of such dislodgment. In order to reduce or avoid such dislodgment of collected impurities, it is helpful to introduce the pressurized gas into the suspension-retaining matrix and pass it therethrough in a non-pulsating manner. Limiting the pressure of the pressurized gas, e.g., to a range of from about 8 to 18 psig in the equipment used in the illustrative examples, and gradual opening of the air valve helped to control the initial impact. Passing the pressurized gas in a continuous stream, i.e., without significant pulsations or pressure variation, avoids pressure fluctuation impacts on the matrix.

Communicating with the outlet end 10*a* of the magnetic separator 10 is manifold conduit 12 joined to a sewer line 14 containing control valve 16 therein and communicating with a sewer or other disposal means. A product line 18 having control valve 20 therein is also joined in communication with manifold conduit 12 to convey purified product to further processing or storage. A flush water line 22 having a control valve 24 therein connects manifold conduit 12 to a source of flush liquid such as flush water inlet 26. A pressurized gas source, in the illustrated embodiment a compressed air source 68, is connected via compressed air line 70 to manifold conduit 12 and has a control valve 72 located therein.

At the inlet end **10*b* of the magnetic separator 10, a manifold conduit 28 has connected to it a discharge line 30 which is fitted with a control valve 32 and in turn connects to sewer line 14, thereby connecting the inlet end 10*b* of magnetic separator 10 to sewage or other disposal. A second flush water line 34 has a control valve 36 therein and connects flush water inlet 26 via manifold conduit 28 to the inlet end 10*b* of magnetic separator 10**.

A feed source 38 supplies a high-solids clay feed to be treated, such as a 60% solids aqueous dispersion of kaolin clay particles containing magnetic colorant impurities. The high-solids clay feed is dispersed with a particular class of dispersant, which may be broadly referred to as an alkaline organic dispersant which is capable of satisfactorily dispersing the high-solids clay suspension not only for preliminary wet processing steps such as blunging, degritting and fractionating, but for magnetic treatment in accordance with the present invention, including flowing the dispersed high-solids suspension through a porous matrix of the magnetic separator 10. The clay solids to be treated is passed from feed source 38 to feed tank 42 via a feed supply line 40 having a control valve 41 therein. A feed inlet line 44 leads from feed tank 42 and has a control valve 46 mounted therein for the controlled introduction of feed into manifold conduit 28. Plug flow is the normal mode of operation during the cycle in which clay slurry is passed upwardly through the magnet. A return line 48 from manifold conduit 28 branches into a feed tank return line 50, which has a control valve 52 therein, and a recovery tank line 54, which has a control valve 56 therein. Feed tank return line 50 connects to feed tank 42 and recovery tank line 54 connects to a recovery tank 58. A transfer line 60 has a control valve 62 therein and connects to feed tank 42. A secondary product line 64 has a control valve 66 therein and connects return line 48 to product line 18.

In operation, a high solids aqueous clay suspension containing magnetic impurities is flowed from feed source 38 via feed supply line 40 into feed tank 42 in which a suitable inventory of feed is retained. From feed tank 42, the clay suspension is passed through feed inlet line 44, control valves 20 and 46 being open and the other valves closed, except for valve 41 which is opened as needed to keep a sufficient inventory in feed tank 42. The feed slurry flows through manifold conduit 28 and then through magnetic separator 10, entering inlet end **10*b*, passing through the porous stainless steel matrix (not shown) within separator 10 and exiting via outlet end 10*a*. Magnetic impurities, under the influence of the magnetic field applied to the matrix in magnetic separator 10, are retained on the matrix which, as described above, comprises a suitable porous ferromagnetic body, such as a body of stainless steel wool. The resultant magnetic impurities-depleted slurry flows via manifold conduit 12 into product line 18**, to further processing or product storage.

The passage of aqueous clay suspension through the magnetic separator 10 is continued with the power source associated with the magnetic circuitry of the separator being continuously energized to maintain the magnetic field continuously applied to the matrix, while the suspension is being flowed therethrough. When a predetermined time has elapsed, or when the matrix has become saturated with collected magnetic impurities or has accumulated a sufficient quantity of such impurities that removal efficiency of the separator 10 has been reduced to a minimum acceptable level, the matrix is regenerated, i.e., cleaned, by removal of collected impurities therefrom.

The length of treatment time before cleaning of the matrix becomes necessary will be a function of the clay suspension being processed, the configuration and characteristics of the magnetic separator, the process conditions such as volumetric flow rate of the clay suspension through the separator, and the type and concentrations of the magnetically attractable particles, e.g., impurities, present in the clay suspension being processed. The magnetically attractable impurities commonly associated with kaolin clays may comprise, for example, one or more of iron, titanium and their oxides, e.g., ferruginous and titania minerals, including colored titania minerals such as iron-stained anatase.

When it becomes necessary to clean the porous matrix, the passage of the clay suspension through the magnetic separator 10 is terminated by closing valves 46 and 20 but maintaining the magnetic field circuitry energized. Valves 72 and 52 are then opened, with all other control valves being closed, in order to introduce a continuous stream of pressurized gas, e.g., compressed air, from compressed air source 68 through compressed air line 70 into manifold conduit 12 and thence into magnetic separator 10 downwardly through the matrix thereof to displace clay suspension retained in the porous matrix. It is a characteristic of the porous ferromagnetic matrix, such as a bed of stainless steel wool, to retain therein a considerable body of suspension or liquid, e.g., the suspension of clay solids being treated or flush water used to clean the matrix, after flow of the suspension or liquid through the matrix is terminated. Such retained suspension of the clay solids being treated is forced by the compressed air through manifold conduit 28 and feed tank return line 50 into feed tank 42. The magnetic field is maintained continuously applied to the matrix during discontinuation of the suspension flow therethrough and the pressurized gas displacement of retained suspension, in order to hold the magnetically attractable impurities in place on the matrix. The suspension which was retained in the matrix upon discontinuation of the flow of suspension therethrough is thus recovered and recycled to feed tank 42 for eventual reconveyance to separator 10 for treatment. Alternatively, valve 52 may be closed during all or a selected stage of such pressurized gas displacement from the matrix of the retained suspension, while either or both of valves 56 and 66 are open, so that the displaced suspension is fed via recovery tank line 54 into recovery tank 58, and/or via secondary product line 64 to product storage or further treatment. Most, if not all, of the magnetically attractable impurities in the suspension displaced from the matrix of magnetic separator 10 by the compressed air are retained on the matrix, the magnetic field having been maintained during the displacement step. Therefore, it may be economical to incorporate all or part of the displaced retained suspension into the product (via secondary product line 64). On the other hand, all or part of the displaced suspension may be sent to recovery tank 58 from which it is transferred to feed tank 42 in desired proportions with fresh feed and recycled for treatment in magnetic separator 10.

Regardless of the specific disposition (to feed tank 42, recovery tank 58 or product line 18) of the recovered solids-containing suspension, because it was displaced from the matrix of magnetic separator 10 by compressed air and not by flush water, the recovered suspension is not diluted. Further, because the magnetic field circuitry is maintained continuously energized during displacement of suspension from the matrix, the magnetically attractable impurities are retained on the matrix during the displacement.

Following the recovery of the displaced suspension, valve 72 (and/or valves 52, 56 and/or 66) are closed, the magnet is de-energized and valves 36 and 16 are opened and all other valves closed to forward-flush the porous matrix in magnetic separator 10 by passing flush water through separator 10 in the same or upward (as viewed in FIG. 1) direction of flow as the suspension is flowed during treatment. The flush water and particles of impurities displaced by it from the porous matrix of separator 10 are discharged via manifold conduit 12 and sewer line 14. After a period of such forward flushing, valves 36 and 16 may be closed and valves 24 and 32 opened (with all other valves closed) to back-flush the matrix of magnetic separator 10 by passing flush water downwardly (as viewed in FIG. 1) therethrough. During such back-flushing, which may be followed by another period of forward-flushing, flush water and magnetic impurities displaced by the flush water from the matrix of separator 10 flow through the manifold conduit 28, discharge line 30 and sewer line 14. After flushing of the matrix of magnetic separator 10 has been completed, valve 24 is closed and valve 72 is opened, so that compressed air from the compressed air source 68 flows into magnetic separator 10 through compressed air line 70, manifold conduit 12 and manifold conduit 28, downwardly through the matrix of separator 10 to displace from it retained flush water. The displaced flush water flows through discharge line 30 and sewer line 14 to sewer disposal. After retained flush water has thus been displaced from the matrix of magnetic separator 10 by the compressed air, valves 72 and 32 are closed, the magnetic circuitry is again energized, and valves 46 and 20 are re-opened to reinitiate passage of the clay suspension through the magnetic separator 10 to start a fresh treatment cycle.

The present invention is seen to provide the advantage of avoiding the waste, heretofore deemed to be unavoidable, inherent in using a flush liquid, e.g., water, to displace from the matrix suspension or slurry retained therein. The prior art practice of flushing the retained suspension from the porous matrix with water results, as noted above, in such high dilution of much of the flushed suspension by the flush water that it becomes unusable and must be sewered or otherwise disposed of. The amount involved is not inconsequential; a typical porous matrix may comprise a substantially cylindrical shaped bed of stainless steel wool about 20 inches or more deep and from about 80 to 120 inches or more in diameter. A matrix of such size can retain a significant quantity of suspension, much if not all of which is lost by the prior art practice on each regeneration cycle, resulting in an operating loss of economical significance. The adverse economic consequences of the prior art practice of using flush water to displace retained suspension or slurry from the matrix is an incentive to delay cleaning of the matrix for as long as possible and to salvage at least an early fraction of the displaced retained suspension. Therefore, the operation of a magnetic separator using the prior art water flush technique involved a number of complicating factors in deciding when to stop operation and clean the matrix and how much of the flush water-diluted displaced suspension could be recovered. A premium was placed upon operator skill and experience in balancing the decline in brightening capacity of the magnetic separator as the concentration of collected impurities on the matrix increased, versus the economic cost and tolerable degree of dilution inherent in recovering at least a portion of the flush water-displaced suspension. By utilizing the practices of the present invention, in which pressurized air (or other gas) is utilized to displace the retained suspension, substantially all of which may thus be recovered without sustaining a dilution effect, the operation may be put on a simple, predetermined time basis or may be set up to respond to a minimum acceptable degree of brightening as the efficiency in removing the colorant impurities decreases because of the build-up of collected impurities on the matrix. It will be appreciated that the sequence of process steps in the practice of the invention may be automatically controlled by a suitable cycle time controller coupled to automatic flow controllers for the control valves of the equipment, whereby the operation of the system may be completely automated in accordance with the cycle time program. This greatly simplifies control of the process and reduces the need for skilled and experienced operators to take into account numerous factors such as the type of clay being processed and the intended end use of the product as affecting the brightness and percent solids required, etc.

Test runs were conducted in clay processing equipment to compare the method of an embodiment of the invention (the "Exemplary Method") to a conventional method (the "Comparative Method"). In the Exemplary Method, which was used to treat both low-solids and high-solids aqueous suspensions of clay, compressed air is used in two different steps to displace from the matrix both retained clay suspension and retained flush water. In the Comparative Method, flush water is used to displace retained clay suspension from the matrix and clay suspension feed is used to displace retained flush water from the matrix. Prior art methods of wet magnetic separation, such as the Comparative Method, are limited to the treatment of low-solids suspensions, e.g., 25% to 35% solids. This is not only because of difficulties in passing the more viscous high-solids suspension through the matrix, but because of the economic infeasibility of subjecting the high-solids suspension to the extent of dilution of the suspension inherent in the prior art wet magnetic separation methods. Accordingly, the Comparative Method could be employed only on low-solids suspensions.

The comparison tests were run in the same installation using either an 84 inch diameter PEM high intensity magnetic separator or a 120 inch diameter PEM high intensity magnetic separator. In each case, the magnetic separator is connected to suspension feed, flush water and compressed air lines in a manner as generally indicated by the schematic diagram of FIG. 1.

The electric power used to energize the electromagnets of the separators was maintained during all tests reported in the Examples at a level to apply a magnetic field of 16 kilogauss to the porous matrix of the separators. The porous matrices comprised substantially cylindrical shaped beds of stainless steel wool, respectively 84 and 120 inches in diameter. In both cases, the stainless steel matrix was 20 inches deep and the steel wool was packed within the canister to a density such that about 94% of the volume of the matrices comprised voids and about 6% of the volume of the matrices comprised stainless steel, providing a porous matrix. The 84 inch diameter stainless steel wool matrix was encased within a canister of 430 U.S. gallons capacity and the 120 inch diameter stainless steel wool matrix was encased within a canister of 860 U.S. gallons capacity.

In the respective descriptions of the Comparative Method and the Exemplary Method set forth below, the lines and valves described correspond to the numbered items of FIG. 1, as follows: the "feed valve" corresponds to valve 46; the "product line valve" corresponds to valve 20; the "water valve" corresponds to valve 36 for forward (upward) flush through separator 10, and to valve 24 for back (downward) flush through separator 10; the "sewer valve" corresponds to valve 16 for sewering during forward (upward) flow through separator 10, and to valve 32 for sewering during back (downward) flow through separator 10; the "compressed air valve" corresponds to valve 72; and the "recycle valve" corresponds to valve 52.

Generally, as will be appreciated from the respective descriptions of the Comparative Method and the Exemplary Method, the feed treatment periods are carried out in substantially the same manner. A significant difference occurs in step 2 in which the Comparative Method utilizes flush water to displace product from the matrix and recovers an initial diluted fraction of the displaced product whereas, in the Exemplary Method, compressed air is used to displace undiluted retained product from the matrix, which product may either be sent to product storage or recycled for further treatment. Flushing of the matrix after removal of retained suspension therefrom is carried out in substantially the same way in both the Comparative and Exemplary Methods, but the displacement of retained flush water from the matrix after the respective Matrix Flush steps is quite different. The Comparative Method utilizes fresh feed to displace retained flush water from the matrix, thereby requiring the disposal to waste of an initial highly dilute fraction of the feed, whereas the Exemplary Method utilizes compressed air to displace and recover an undiluted feed from the matrix.

Comparative Method (Conventional)

For test runs using conventional techniques, the following procedure was employed to treat low-solids aqueous suspensions of clay.

1. Feed Treatment Period. Energize the magnet, close the water valves, and open the feed valve and product line valve to pass the feed of the aqueous clay suspension to be treated upwardly through the matrix while a 16 kilogauss magnetic field is applied to the matrix. Typical feed rates for wet magnetic treatment of low-solids aqueous clay suspensions were employed, about 300 to 500 gallons per minute for the 84 inch diameter magnet and about 600 to 1000 gallons per minute for the 120 inch diameter magnet.

2. Clay Recovery By Water. While maintaining the magnet in an energized condition, close the feed valve and open the water valve and product line valve to flow 300 gallons per minute of flush water upwardly through the matrix and flow the displaced (and eventually diluted) suspension to product.

3. Clay Purge. At a predetermined maximum allowable dilution of the clay suspension, close the product line valve, de-energize the magnet and open the sewer valve to continue to flow upwardly through the matrix and to the sewer the very dilute clay suspension being purged from the matrix by the flush water.

4. Matrix Flush. Open water valve to flow flush water upwardly through matrix to flush magnetically attractable impurities from the matrix to sewer. For the 84 inch diameter magnet, a flow rate of about 1200 to 1500 gallons per minute was employed and for the 120 inch diameter magnet a flow rate of about 2000 to 2200 gallons per minute was employed. Reverse direction of flow of flush water after an initial period to back-flush matrix, and then finish with an additional period of forward flow (upwardly) through matrix.

5. Displace Water. Energize magnet, open feed valve to pass feed upwardly through the matrix, keeping the sewer valve open and product line valve closed in order to displace, with the feed, flush water retained in the matrix, and flow the resultant highly diluted suspension to sewer.

6. End Cycle. At a predetermined maximum acceptable dilution level (minimum acceptable solids content), close valve to sewer and repeat step 1 above to initiate another treatment period.

Exemplary Method (In Accordance With An Embodiment Of The Invention)

For test runs using a technique in accordance with an embodiment of the present invention, the following technique was employed for wet magnetic treatment of both low-solids and high-solids aqueous clay suspensions.

1. Feed Treatment Period. Energize the magnet, close the water and air valves, and open the feed valve and product line valve to pass the feed of the aqueous clay suspension to be treated upwardly through the matrix while a 16 kilogauss magnetic field is applied to the matrix. The feed rates of the aqueous clay suspension are the same as those of the Comparative Method.

2. Clay Recovery By Compressed Air. While maintaining the magnet in an energized condition, simultaneously close the feed valve and product line valve, and open the compressed air valve and recycle valve, to provide a continuous compressed air force at 13 psig to displace suspension retained in the matrix back into the feed tank or into the recovery tank. (It should be noted that suspension in the matrix has been magnetically processed at the time of displacement of it from the matrix. Thus, additional overall brightness improvement can be obtained by sending it back to the feed tank for eventual recycle through the magnetic separator. However, should the alternate procedure of sending the displaced suspension to the recovery tank be chosen, brightened product can be obtained directly from the recovery tank.)

3. Matrix Flush. Close compressed air valve and recycle valve, de-energize the magnet, and open flush water valve and sewer valve to flow flush water upwardly through the matrix to flush magnetically attractable impurities from the matrix to sewer. The same flow rates as used in the Comparative Method were used, i.e., about 1200 to 1500 gallons per minute for the 84 inch diameter magnet and about 2000 to 2200 gallons per minute for the 120 inch diameter magnet. Reverse direction of flow of flush water after an initial period to back-flush matrix and then finish flush with additional period of forward flow (upwardly) through matrix.

4. Displace Water. Close flush water valve and open compressed air valve and sewer valve to continuously flow compressed air at 13 psig downwardly through the porous matrix to force flush water retained in the matrix to the sewer. In the treatment of low-solids clay suspensions, the compressed air was applied for 45 seconds and in the treatment of high-solids clay suspensions the air was applied for 120 seconds. (The reason for the different time periods is explained below.)

5. End Cycle. Close compressed air valve and sewer valve and repeat step 1 to initiate another treatment period.

Step 4, the "Displace Water" step of the Exemplary Method, was carried out for only 45 seconds when treating low-solids clay suspensions because it was deemed that the greater production rate (tons of clay processed per cycle) attained by shortening the cycle time required for this step warranted accepting the higher flush water dilution that ensued. Higher flush water dilution is sustained because residual flush water retained in the matrix due to the reduced duration of the "Displace Water" step diluted the feed suspension introduced in the next cycle. In the treatment of high-solids clay suspensions, the production rate is high because of the greater solids content per gallon of suspension, and more cycle time was devoted to the "Displace Water" step in order to more completely remove flush water from the matrix and correspondingly reduce dilution of the high-solids suspension feed to the matrix in the next cycle. Balancing the cycle time devoted to the "Displace Water" step 4 of the Exemplary Method against the amount of flush water so displaced will depend on the economics in a given case of the relative values of production rate and amount of dilution sustained. In any case, for high-solids suspensions, removal of flush liquid by the pressurized gas is carried out to remove most if not all of the flush liquid, e.g., to remove at least about two-thirds, preferably at least about three-quarters, e.g., at least about nine-tenths, of the retained flush liquid.

Figure 2:
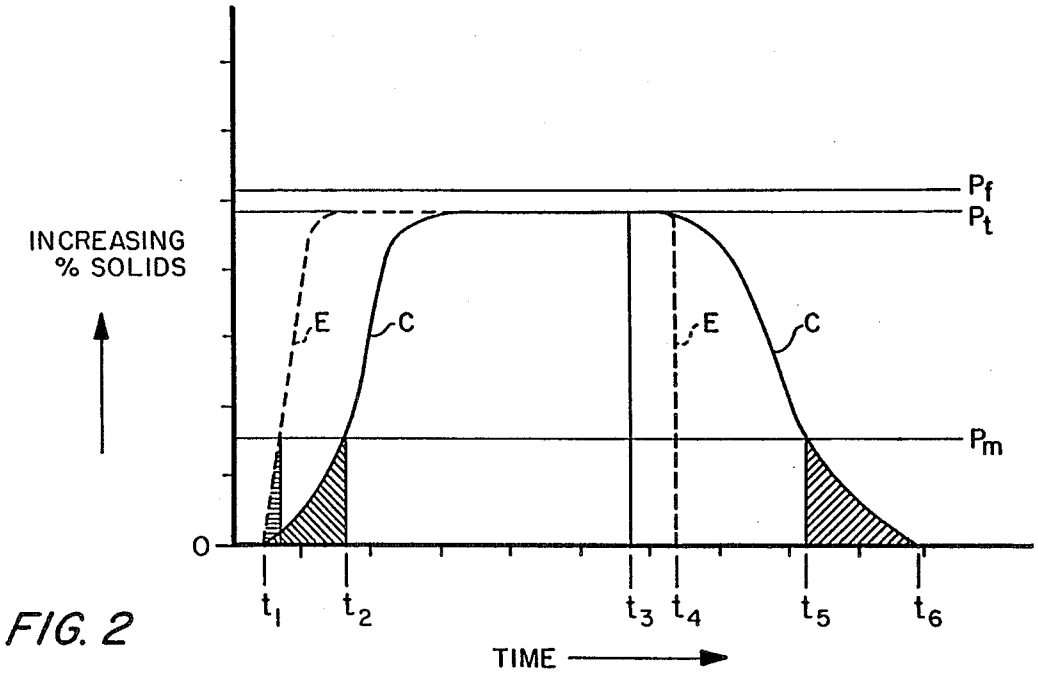
FIG. 2 is a plot showing typical percentage of solids in a suspension discharged from a magnetic separator during a magnetic separation treatment cycle.

The differences with respect to the yields provided by, respectively, the Comparative and Exemplary Methods is graphically illustrated in FIG. 2 which plots on the vertical axis percent solids of the suspension feed against, on the horizontal axis, time. Dash line E represents the Exemplary Method and solid line C the Comparative Method and shows the percent solids in the discharge from the magnetic separator (10 in FIG. 1) at various times during the process. Referring now to the solid line curve C of the Comparative Method, time $t_1$ corresponds to the commencement of step 5, the "Displace Water" step. Clay suspension feed is introduced into the matrix of the magnetic separator which is laden with retained flush water. The percent solids of the material being discharged from the matrix is accordingly initially zero at the initial displacement of water and gradually builds up as flush water is displaced from the matrix and replaced with clay suspension. At time $t_2$ the percent solids attains the value $P_m$, which is the minimum acceptable percent solids which can be tolerated in the product, i.e., the predetermined maximum acceptable dilution level mentioned in "End Cycle" step 6 of the Comparative Method. "Feed Treatment Period" step 1 of the Comparative Method now commences and the percent solids increases until it attains the value $P_t$, which is the percent solids content of the product leaving the porous matrix during the steady state portion of the step 1 "Feed Treatment Period". Reduction of the solids content by separation of the magnetically attractable impurities is a factor in reducing the solids content to the value $P_t$, which is somewhat less than the solids content value $P_f$, which is the percent solids content of the feed to the process. The Exemplary Method of the invention, as explained in detail below, sustains substantially less dilution than does the Comparative Method of the prior art. Thus, for a given feed solids value $P_f$, the solids value $P_t$ will be greater for the Exemplary Method than for the Comparative Method. However, for the sake of simplicity of illustration and comparison, a single value for $P_t$ is shown as common to the Exemplary and Comparative Methods. At time $t_3$, the "Clay Recovery By Water" step 2 of the Comparative Method is initiated. Time $t_3$ is determined either by a predetermined treatment time cycle or by incipient or actual saturation of the matrix with collected impurities or incipient or detected decrease in clay brightness attained by the process. In any event, in step 2 of the Comparative Method flush water is introduced into the matrix to displace retained clay suspension therefrom. Initially, the displaced clay suspension shows a solids content of $P_t$ as a front of substantially undiluted clay suspension is displaced from the matrix by the flush water. However, as flush water replaces and dilutes clay suspension, the percent solids value drops off until at time $t_5$ it declines to the predetermined maximum acceptable dilution level $P_m$ at which time the "Clay Purge" step 3 of the Comparative Method is initiated, with the highly dilute clay suspension being sewered together with impurities retained on the matrix. At time $t_6$ the clay suspension and collected solid impurities are flushed from the porous matrix and the solids content is at or near zero. The treatment cycle is then repeated. The diagonally cross-hatched sections under curve C represent the clay solids losses to sewer encountered during the Comparative Method. The losses between times $t_1$ and $t_2$ represent the loss by sewering of clay solids in that portion of the feed suspension which is highly diluted by the matrix-retained flush water it is displacing from the matrix. The losses between times $t_5$ and $t_6$ represent clay solids lost during displacement from the matrix by flush water of retained feed suspension and the sewering of the resultant highly dilute suspension during the latter stage of that step.

In order to facilitate comparison, dash line curve E of the Exemplary Method is shifted horizontally relative to curve C so that time $t_1$ represents on curve E the commencement of "Feed Treatment Period" step 1. The rate of percent solids increase starting at time $t_1$ of curve E is greater than that of curve C because much or most of the flush water retained in the matrix has (in "Displace Water" step 4) been displaced from the matrix by compressed air. Accordingly, dilution of the clay suspension fed to the matrix is greatly lessened, the maximum acceptable dilution level $P_m$ is attained much more rapidly, and solids losses are avoided because the degree of dilution is so small that even the initial discharge from the matrix may be sent to product. At time $t_3$, step 1 is terminated and "Clay Recovery By Compressed Air" step 2 is commenced, but in this case by the utilization of compressed air. Consequently, the percent solids of the suspension discharged from the matrix remains at the percent solids level $P_t$ and then drops precipitately as the matrix is cleared by the compressed air of retained feed suspension. Consequently, solids losses at this part of the cycle are substantially eliminated.

As well illustrated by FIG. 2, it is seen that significant reductions in clay solids losses are provided by the Exemplary Method as compared to the Comparative Method both in the $t_1$ to $t_2$ time frame and in the $t_4$ to $t_6$ time frame. As shown by the $t_1$ to $t_2$ segment of FIG. 2, the Exemplary Method provides reduced dilution by pressurized gas displacement from the matrix of a substantial portion, if not all, of the flush liquid by pressurized gas, with only the remaining flush liquid displaced from the matrix by the feed suspension which sustains little or nearly no dilution thereby. In contrast, the Comparative Method uses the feed suspension to displace all the retained flush liquid from the matrix, sustaining significant dilution thereby. Further, as shown by the $t_4$ to $t_6$ segment of FIG. 2 the Exemplary Method substantially eliminates solids losses by displacing with pressurized gas retained product suspension from the matrix, and recovering or re-cycling the displaced suspension. In contrast, the Comparative Method uses the flush liquid to displace feed suspension from the matrix resulting in dilution of the displaced slurry to an extent that, as a practical matter, requires sewering of the most highly diluted portion of the displaced suspension and acceptance of significant dilution of the retained portion. Thus, using a pressurized gas in accordance with the teachings of the invention to displace retained suspension from the porous matrix effects a substantial portion, usually the larger portion, of the efficiencies provided by the method of the present invention. In fact, significant improvements would be attained as compared to prior art techniques if the pressurized gas were used solely to displace feed suspension from the porous matrix, with flush liquid being displaced from the matrix entirely by the feed suspension.

All reference to particle sizes in this specification and claims are to sizes as determined by use of a SEDIGRAPH ® 5000 particle size analyzer and are reported on the basis of maximum equivalent spherical diameter of a stated weight percentage of the material. Similarly, all references to GE brightness refers to GE brightness as measured by the Technical Association of the Pulp and Paper Industry (TAPPI) Standard T452-M-58.

The following Examples 1–4 all treat low-solids clay suspensions in order to provide a uniform basis for comparing the Exemplary and Comparative Methods; for the reasons noted above, use of the Comparative Method is not feasible with high-solids clay suspensions.

EXAMPLE 1

An aqueous suspension of dispersed kaolin clay particles having an average feed solids of 32.0 percent were treated in a performance test of the Comparative Method as described above, using the above-described 84 inch magnet. The clay suspension had a nominal particle size of 80% by weight finer than 2 microns equivalent spherical diameter. The performance test took place over a period of fifteen consecutive days monitored during three of the fifteen operational days for product brightness and yield. A similar clay suspension having an average solids content of 32.2% and a nominal particle size of 80% by weight finer than 2 microns equivalent spherical diameter was then treated in a performance test of the Exemplary Method as described above over a period of fourteen consecutive days and was monitored for two of the operating days. Both performance tests were carried out in the same equipment and in the Exemplary Method, the "Displace Water" step 4 was carried out for only 45 seconds, in order to enhance productivity, accepting concomitant increased dilution of the brightened clay product. The solids content of the respective products obtained from the two Methods of treatment are shown in Table I.

TABLE I

| | Average Solids | | |
|---|---|---|---|
| Method | Clay Feed | Purified Clay Product | Purified Clay Product Yield |
| Comparative | 32.0% | 25.9% | 92.8% |
| Exemplary | 32.2% | 30.7% | 97.4% |

Table I shows that even when the Exemplary Method is operated in a production-enhancing and dilution-accepting mode, it provided a significantly higher yield than the Comparative Method.

As shown by the data of Table I, the method of the present invention provides a suspension of magnetically purified clay having considerably higher solids, and also provides an increased yield of purified clay. The clay suspension treated by the Exemplary Method sustained significantly less dilution by flush water as compared to that treated by the Comparative Method. The reduced percent solids of the product in both cases results not only from dilution of the product with flush water, but also from losses of clay and the removal of magnetically attractable impurities from the clay suspension. If one assumes that an average of 16,000 lbs. (dry basis) of clay solids are treated during a single treatment cycle, the 4.6 percent improvement (97.4%–92.8%) in yield of the Exemplary Method over the Comparative Method shown in Table I represents an increase of 736 lbs. (dry basis) of product per cycle of operation. At a typical cycle time of 18 minutes, this is more than 2,450 lbs. (dry basis) of additional clay product per hour of operation.

The extent of flush water dilution sustained by the Comparative Method as compared to the Exemplary Method may be calcuated with respect to the data of Table I as follows.

Flush Water Dilution Sustained by Comparative Method

A feed composition of 32.0% solids has 7.05 lbs. of water and 3.32 lbs. of clay per gallon of suspension. A product composition of 25.9% solids has 7.34 lbs. of water and 2.57 lbs of clay per gallon of suspension. Assuming 16,000 lbs. of clay (dry basis) are treated per cycle, and no product or water losses, then:

$$\frac{16{,}000 \text{ lbs. clay}}{3.32 \text{ lbs. clay per gallon}} = \begin{array}{l}\text{4,819 gallons of feed}\\ \text{per treatment cycle}\end{array}$$

$$\frac{16{,}000 \text{ lbs. clay}}{2.57 \text{ lbs. clay per gallon}} = \begin{array}{l}\text{6,225 gallons of product}\\ \text{per treatment cycle}\end{array}$$

$$6{,}255 - 4{,}819 = 1{,}406 \quad \begin{array}{l}\text{gallons of flush water}\\ \text{added to product per}\\ \text{treatment cycle}\end{array}$$

Flush Water Dilution Sustained by Exemplary Method

A feed composition of 32.2% solids has 7.04 lbs. of water and 3.35 lbs of clay per gallon of suspension. A product composition of 30.7% solids has 7.11 lbs. of water and 3.11 lbs. of clay per gallon of suspension. Assuming 16,000 lbs of clay (dry basis) are treated per cycle, and no product or water losses, then:

$$\frac{16{,}000 \text{ lbs. clay}}{3.35 \text{ lbs. clay per gallon}} = \begin{array}{c}4{,}776 \text{ gallons of}\\ \text{feed per treatment cycle}\end{array}$$

$$\frac{16{,}000 \text{ lbs. clay}}{3.11 \text{ lbs. clay per gallon}} = \begin{array}{c}5{,}145 \text{ gallons of}\\ \text{product per treatment cycle}\end{array}$$

$$5{,}145 - 4{,}776 = \begin{array}{l}369 \text{ gallons of flush water added}\\ \text{to product per treatment cycle}\end{array}$$

The foregoing dilution calculations are conservative in that they do not take into account the reduced solids in the product caused by removal of the magnetically attractable impurities. Further, as noted above, in order to enhance the production rate not as much flush water was removed from the matrix by compressed air as might have been. In cases where sustaining less dilution by flush water warrants a longer cycle time between feed treatment periods (as in the treatment of high-solids suspensions) the duration of step 4 "Displace Water" of the Exemplary Method would be increased to displace more of the flush water. In any case, the calculations shows a marked reduction in dilution of the product by flush water (a reduction of 1,406−369=1,037 gallons per cycle) provided by operating in accordance with the teachings of the present invention, as compared to operating in accordance with prior teachings.

Comparison of Energy Requirements For Spray Drying

If a high-solids clay feed is to be magnetically treated and then spray dried, the Exemplary Method affords significant energy savings as compared to the Comparative Method. The following calculations are based on assuming a feed solids of 61.5%, the same dilutions as calculated above for the two methods, 16,000 lbs. of clay treated per cycle, and 100% efficiency for the magnetic treatment.

At 61.5% solids, the aqueous clay suspension comprises 5.18 lbs. of water and 8.26 lbs. of clay per gallon, for a density of 13.44 lbs. per gallon of suspension. Accordingly, the feed volume treated per cycle is $$\frac{16{,}000 \text{ lbs. clay}}{8.26 \text{ lbs. clay per gallon}} = \begin{array}{c}1{,}937 \text{ gallons of}\\ \text{suspension}\end{array}$$

In the Comparative Method, 1,406 gallons of water dilution per cycle is sustained so the volume of the product suspension is $$1{,}937 + 1{,}406 = 3{,}343 \text{ gallons of suspension,}$$

and the percent solids of the product is $$\frac{16{,}000 \text{ lbs. clay}}{3{,}343 \text{ gallons suspension}} = 4.78 \text{ lbs. clay per gallon} = 42.4\% \text{ solids}$$

At 42.4% solids, the product comprises 4.78 lbs. of clay and 6.50 lbs. of water per gallon, or 1.36 lbs. of water per lb. of clay.

In the Exemplary Method, 369 gallons of water dilution is sustained per cycle so the volume of the product suspension is $$1{,}937 + 369 = 2{,}306 \text{ gallons of suspension,}$$

and the percent solids of the product is $$\frac{16{,}000 \text{ lbs. clay}}{2{,}306 \text{ gallons suspension}} = 6.94 \text{ lbs. clay per gallon} = 55\% \text{ solids}$$

At 55% solids, the product comprises 6.94 lbs. of clay and 5.68 lbs. of water per gallon, or 0.82 lbs. of water per lb. of clay.

Thus, with the Comparative Method an additional amount of water, amounting to $$1.36 - 0.82 = 0.54 \text{ lbs. of water per lb. of clay}$$

must be removed in spray drying.

Assume that about 1,000 BTU per lb. of water is required to heat and evaporate the water content of the product fed to the spray dryer, and the spray dryer is 75% thermally efficient. Then, the extra energy required for spray drying the 42.4% solids product of the Comparative Method as compared to the 55% solids product of the Exemplary Method is calculated as $$\frac{0.54 \text{ lbs. water}}{\text{lb. clay}} \times \frac{1{,}000 \text{ BTU}}{\text{lb. water}} \times \frac{1}{0.75} = \frac{720 \text{ BTU}}{\text{lb. clay}}$$

720 BTU per lb. of clay is equivalent to 1,440,000 BTU per ton of clay or 14.4 Therms per ton of clay. At an energy cost of $0.40 per Therm ($0.40 per 100,000 BTU), the spray drying energy cost for the product of the Comparative Method is $5.76 per ton of clay more than the spray drying energy cost for the product of the Exemplary Method. Spray dryer capacity in terms of dried clay product is of course inversely proportional to the water content of the suspension being dried and so, aside from energy costs, fixed costs associated with separation and maintenance of the dryer increase per unit weight of dried clay with increasing water content of the suspension. Of course, in actual practice the 42.4% solids product of the above example of the Comparative Method would not be spray-dried at that dilution, but would be mechanically dewatered to increase its solids content, typically to a level of 55 to 60% solids.

EXAMPLE 2

Performance tests similar to those of Example 1 were conducted utilizing the above-described 120 inch magnetic separator. An aqueous clay suspension feed similar to that utilized in Example 1 was run in a performance test utilizing the Comparative Method for a ten consecutive day operating period, during two days of which monitoring was carried out to obtain the data set forth below. This was followed by utilizing a similar clay feed in a performance test, carried out in the same equipment, utilizing the Exemplary Method in a 13 consecutive day operating period in accordance with two days of monitoring during the 13 day period to obtain the data set forth below. As in Example 1, a 45 second period was used for the "Displace Water" step 4 of the Exemplary Method. The solids content of the products obtained from the performance tests of the two Methods of treatment are set forth in Table II below.

TABLE II

| | Average Solids | | |
|---|---|---|---|
| Method | Clay Feed | Purified Clay Product | Purified Clay Product Yield |
| Comparative | 30.3% | 27.5% | 92.9% |
| Exemplary | 32.0% | 30.8% | 97.1% |

Calculations similar to those shown above with respect to Table I show that the product of the Comparative Method sustained a dilution of 2,812 gallons of flush water per cycle and the product of the Exemplary Method sustained a dilution of only 738 gallons of flush water per cycle. Therefore, a reduction of 2,812−738 or 2.074 gallons of dilution per cycle is attained by practicing a technique in accordance with the present invention instead of a prior art technique.

EXAMPLE 3

In order to compare the respective increases in brightness obtained by using the Comparative and Exemplary methods of treatment, the 120 inch magnetic separator used in Example 2 was fitted with a new stainless steel wool matrix and utilized to treat an aqueous clay suspension. The clay was a Washington County, Ga., soft kaolin clay dispersed by an alum-silicate hydrosol as disclosed in U.S. Pat. No. 3,462,013. The clay particles had a particle size of 80% by weight finer than 2 microns equivalent spherical diameter. The first nine consecutive days of operation were carried out in accordance with the Comparative Method described above and the average GE brightness gain for the nine days of treatment by the Comparative Method was 3.13. The same equipment and matrix was then operated for 21 consecutive days in accordance with the Exemplary Method described above and the average GE brightness gain was 4.84. Thus, the brightness-enhancing results attained by the Exemplary Method in accordance with the practice of the invention were better than those attained utilizing the Comparative Method.

Without wishing to be bound by any particular theory, the fact that better GE brightness is attained with the Exemplary Method may be explained by the fact that in the Exemplary Method, clay suspension retained in the matrix at the end of a treatment period was recycled and so passed through the magnetic separator a second time. In the Comparative Method, a portion of the suspension retained in the matrix at the end of a treatment period is sent to product and the remainder is sewered, so none of the suspension passes twice through the separator. With the Comparative Method, dilution of the magnetically treated suspension displaced from the matrix by the flush water precludes recycling of at least the initially displaced portion of the suspension.

EXAMPLE 4

The equipment utilized in Example 3 was used to compare the Comparative and Exemplary Methods in the treatment of an aqueous suspension of soft kaolin clay which was dispersed with a mixture of sodium silicate and soda ash. The clay had a particle size of 80% by weight of the particles finer than 2 microns equivalent spherical diameter. The Comparative Method was run for nine consecutive operating days and then the Exemplary Method was run for 22 consecutive days in the same equipment. The average GE brightness gain for the Comparative Method was 3.80 and for the Exemplary Method was 4.24.

EXAMPLE 5

The 84 inch magnet equipment of Example 1 was used to treat, by the Exemplary Method of the present invention, a high-solids, coating clay fraction comprised of two Wilkinson County, Ga. kaolin clays as follows: two parts by weight of a Klondyke coarse, soft kaolin clay and one part by weight of L. D. Smith fine, hard low viscosity clay. The clay was dispersed with approximately 5 lbs. (dry basis) per ton of a dispersant comprising sodium polyacrylate and sodium hydroxide in a 3.50:0.75 weight ratio (dry basis) and had a size range of 82% by weight of the particles finer than 2 microns equivalent spherical diameter. This amount of dispersant is in excess of the amount required to obtain optimum Brookfield viscosity. (Such over-dispersal of the suspension has been found to be advantageous in wet magnetic separation of high-solids clay suspensions.) The fractionated, degritted clay feed to the magnet contained 61% solids and had an average GE brightness of about 80.3.

This 61% solids slurry of fractionated degritted clay had been produced as follows. Laboratory analysis of preblended crude clays was completed to establish the conditions for primary dispersion. Previously stockpiled clay crude was fed to a shredding device, and pulverized in a conventional manner, utilizing a frontend loader which fed the clay crudes in the desired ratio. Shredded clay was transported to a vertical shafted single stage blunger at a uniform feed rate of approximately 25 tons per hour. Water and dispersant was added to the blunger, maintaining designated pH by injecting dispersing agents into the water stream. The dispersants had been preblended to the ratio above mentioned. Approximately 15 horsepower per ton of energy was required to disperse the crude clay. Dispersed crude in excess of 70% solids was then passed through a 20 mesh screening device to isolate clay lumps and other foreign matters. Rejected material from the 20 mesh screen was subjected to secondary blunging and was then subsequently recycled to the primary blunger for recovery. Screened crude was transported by a centrifugal pump to a holding vessel used to feed a solid bowl centrifuge operating at nominally 1,000 G. for separation of grit. Degritted crude was then transported to a second holding vessel for fractionation to the desire particle size. The slurry fed to the centrifuge was at about 68% solids.

The magnetic treatment provided a 56% solids product having a brightness improvement of 3.0 GE. The treated product was recycled and identically treated a second time, and a further brightness improvement of 1.7 GE was attained in a product having 51% solids.

EXAMPLE 6

The 84 inch magnet equipment utilized in Example 1 was utilized to treat, by the Exemplary Method of the invention, another portion of a high-solids aqueous suspension of the same clay as treated in Example 5 but having a size range of 78% by weight of the particles finer than 2 microns equivalent spherical diameter. The feed of fractionated, degritted clay was at 62% solids and had an average GE brightness of about 80.3. The feed slurry had been dispersed with approximately 5 lbs. (dry basis) per ton of clay of a dispersant comprised of sodium polyacrylate and sodium hydroxide in a 3.50:0.75 weight ratio. The steps involved in the preparation of the 62% solids feed slurry were substantially identical to those used in Example 5.

Four separate runs in the magnetic separator were carried out using different operating cycles, as follows:

| Run | Net[1] Tonnage | Residence[2] Time |
|---|---|---|
| 1 | 4 | 2 minutes |
| 2 | 5 | 2 minutes |
| 3 | 5 | 1.5 minutes |
| 4 | 5 | 1.5 minutes |

[1]The Net Tonnage is the total short tons of clay (dry basis) treated in the magnet, less the amount displaced from the porous matrix of the magnet (and eventually re-cycled).
[2]Residence Time is the average residence time of clay within the porous matrix for magnetic treatment.

The following results were obtained:

| Run | Product Clay Solids | GE Brightness Increase |
|---|---|---|
| 1 | 59.0% | 3.2 |
| 2 | 57.6% | 3.1 |
| 3 | 58.9% | 3.2 |
| 4 | 56.6% | 3.4 |

EXAMPLE 7

The 84 inch magnet equipment of Example 3 was used to treat, by the Exemplary Method of the invention, a high solids aqueous suspension of a fine particle size fraction of a degritted hard white clay from the Gibraltar mine, which is located in Wilkinson County, Ga. The fractionated clay was nominally 90% finer than 2 microns. The clay was dispersed with about 5 lbs. (dry basis) per ton of clay of a dispersant comprising sodium polyacrylate and sodium hydroxide in a weight ratio of 3.50:0.75. This amount of dispersant is in excess of the amount required to obtain optimum Brookfield viscosity. Three separate tests were run and the following results were attained.

| | Feed | | Product | | GE Brightness |
|---|---|---|---|---|---|
| Test | Solids | GE | Solids | GE | Increase |
| 1 | 63.0% | 86.5 | 57.7 | 87.9 | 1.4 |
| 2 | 63.0% | 86.5 | 57.3 | 87.9 | 1.4 |
| 3 | 61.6% | 86.5 | 61.5 | 87.4 | 1.6 |

The following Example 8 illustrates the wet processing of a crude kaolin clay at various solids levels and provides a comparison of the use of a conventional silicate dispersant with an alkaline polyacrylate dispersant.

EXAMPLE 8

The tests carried out in the example demonstrate the superiority of the preferred organic dispersant system (alkaline polyacrylate) over a sodium silicate dispersant used in conventional manner. Eight separate batches of crude clay (Klondyke coarse, soft kaolin Clay from Wilkinson County, Ga.) were blunged for 10 minutes in a Littleford mixer at, respectively, 40%, 50%, 60% and 70% solids levels using various amounts of either a sodium silicate dispersant (N® Brand sodium silicate having a $SiO_2/Na_2O$ molar ratio of about 3.3/1) or an alkaline polyacrylate dispersant comprised of 3.5 parts by weight of sodium polyacrylate and 1.0 parts by weight NaOH. All of the blunged clay was screened through a 325 mesh (Tyler) screen; none of the degritted slurries was fractionated. Batches 1A, 2A, 3A and 4A were dispersed with alkaline polyacrylate dispersant and Batches 1S, 2S, 3S and 4S with silicate dispersant, in the following amounts:

TABLE III

| Batch | Dispersant lbs. per ton[1] | pH | % Solids |
|---|---|---|---|
| 1A | 5.0 | 5.9 | 40 |
| 2A | 5.0 | 6.1 | 50 |
| 3A | 5.0 | 6.0 | 60 |
| 4A | 5.0 | 6.0 | 70 |
| 1S | 3.5 | 5.2 | 40 |
| 2S | 4.5 | 5.2 | 50 |
| 3S | 5.0 | 5.0 | 60 |
| 4S | 5.0 | —[2] | 70 |

[1]lbs. of dispersant (dry basis) per short ton (2,000 pounds) of clay, dry basis.
[2]Using the sodium silicate dispersant, the 70% solids clay-water system could not be formed into a fluid slurry using 5 lbs. per ton dispersant. Therefore, makedown was not pursued further.

It should be noted that all batches identified by the letter "S" were over dispersed in accordance with the invention and batches identified by the letter "S" were dispersed to optimum Brookfield manner, in convention manner. The makedown batches (1A–4A and 1S–3S) were screened through a 325 mesh screen and Batches 1A–4A seemed to screen more easily than Batches 1S–3S. The batches were then wet magnetically treated using the Exemplary Method in pilot plant test equipment (PEM, 1" Canister) under conditions including supplying electric current to the magnet at 530 amps and 180 volts to impose on the matrix a magnetic field of 16,000 gauss strength. The steps of the Exemplary Method were carried out as follows:

Step 1—Feed Treatment Period:

| | |
|---|---|
| Batches 1A and 1S (40% solids) | 624 seconds |
| Batches 2A and 2S (50% solids) | 456 seconds |
| Batches 3A and 3S (60% solids) | 348 seconds |
| Batch 4A (70% solids) | 268 seconds |

All Batches were treated at a feed rate of 481 cubic centimeters ("cc") of feed suspension per minute, which corresponds to 2 minutes residence time. The above feed rates simulating a 5 ton net cycle on an 84" magnet.

Step 2—Clay Recovery By Compressed Air:

120 seconds, continuous application of air at about 15 psig

Step 3—Matrix Flush:

40 seconds forward flush.

40 seconds back flush.

Step 4—Displace Water:

120 seconds, continuous application of air at about 15 psig.

The percent solids of the clay suspension feed to the magnet and the brightened product discharged from the magnet are reported in Table IV. It should be carefully noted that % solid reported in this table reflects undesired dilution which was rectified in operating commercial scale magnets. It is believed that this will explain data for Batch 4A.

TABLE IV

| Batch | % Solids Clay Feed | % Solids Brightened Clay Product |
|---|---|---|
| 1A | 41.67 | 36.68 |
| 2A | 52.59 | 47.09 |
| 3A | 62.14 | 56.06 |
| 4A | 65.00 | 45.20 |
| 1S | 41.00 | 37.35 |
| 2S | 50.81 | 46.77 |
| 3S | 63.47 | 54.21 |

The clay dispersed with the alkaline polyacrylate dispersant (Batches 1A–4A) showed better results than the clay dispersed with the silicate dispersant (Batches 1S–3S) with respect to yields, brightness and residual $TiO_2$ and $Fe_2O_3$. However, the silicate-dispersed high-solids suspensions were successfully treated by the method of the invention except, of course, with respect to the 70% solids slurry which could not be madedown with the amount of silicate dispersant used. The GE brightness enhancement and residual $TiO_2$ and $Fe_2O_3$ remaining in the brightened clay is set forth in the following Table V.

TABLE V

| Batch | Clay Feed GE | Clay Feed $TiO_2$ | Clay Feed $Fe_2O_3$ | Treated Clay Product GE | Treated Clay Product $TiO_2$ | Treated Clay Product $Fe_2O_3$ | Delta GE[1] |
|---|---|---|---|---|---|---|---|
| 1A | 75.6 | 1.45 | .52 | 84.8 | .71 | .34 | 9.2 |
| 2A | 74.8 | 1.55 | .56 | 83.7 | .80 | .35 | 8.9 |
| 3A | 74.9 | 1.49 | .53 | 81.9 | .99 | .38 | 7.0 |
| 4A | 75.3 | 1.49 | .53 | 80.8 | 1.07 | .39 | 5.5 |
| 1S | 76.8 | 1.53 | .45 | 82.9 | .96 | .35 | 6.1 |
| 2S | 75.4 | 1.49 | .52 | 81.6 | .91 | .37 | 6.2 |
| 3S | 75.1 | 1.48 | .52 | 79.7 | 1.20 | .41 | 4.6 |

[1]Increase in GE brightness attained by the treatment

The data of Example 8 show a distinct advantage in the use of alkaline polyacrylate dispersant in the wet magnetic separation of high-solids clay suspension.

EXAMPLE 9

In order to demonstrate bleaching a magnetically purified clay slurry while the slurry is in dispersed condition, in accordance with the invention, samples of the slurries of magnetically brightened clay obtained from Example 6 were divided into two batches of 60.9% solids. K-Brite® bleach (type 3E) was used in some tests. This bleach was used in the form of an aqueous solution nominally containing 1 pound of active sodium hydrosulfite per gallon of solution. The pH of this solution was about 8. When added to a clay slurry, the pH of the slurry will increase slightly and then decrease to approximately the original pH. For example, when the bleach is added to a slurry of magnetically purified clay having a pH of 6.5, the pH will initially increase to a value of approximately 7, the value depending on the amount of bleach. After the bleach reaction takes place, pH of the slurry will be about 6.5 or slightly below.

Batch 1 comprised 55.2 lbs. of suspension containing 33.65 lbs. (dry basis) of clay. Batch 2 comprised 53.375 lbs. of slurry containing 32.51 lbs. of clay.) Batch 1 was treated with 2 lbs. per ton of dry clay of K-Brite bleach. (dry bleach basis). Batch 2 was treated with 2 lbs. per ton of dry clay of zinc hydrosulfite (dry bleach basis). Both batches were stirred for approximately 30 minutes in order to thoroughly mix the bleach and, thereafter were occasionally stirred with a spatula.

Approximately 24 hours later, both batches were spray dried and 25 lb. samples of the dried samples were madedown in a drill press at 70% solids. A biocide (AMA-424) was added to the slurry in an amount of 500 ppm. The madedown sample from Batch 1 was at 69.95% solids and the madedown sample from Batch 2 was at 69.99% solids. Each of the two samples was divided into two parts, one part being stirred using a Talboy laboratory stirrer and the other part left undisturbed. All four samples were protected by paper plate covers from dust contamination.

Prior to the bleaching operation, the samples showed a GE brightness of 85.2. Batch 1, 24 hours after the bleaching with the K-brite, showed a GE brightness of 86.4 Batch 2, 24 hours after bleaching with the zinc hydrosulfite, showed a GE brightness of 86.5.

The brightness of each of the four samples, i.e., a stirred and a static sample for each of the K-Brite and zinc hydrosulfite bleached batches, fell for approximately three days after the reslurrying and bleach treatment, e.g., to 85.6 and 85.7 for, respectively, the static and stirred Batch 1 (K-brite) samples and 85.9 for both the static and stirred Batch 2 (zinc hydrosulfite) bleached samples. However, after one week brightness started to increase for all samples and recovered after four weeks to nearly the original brightness, e.g., 86.1 for the static and stirred Batch 1 samples and 86.4 for the static and stirred Batch 2 samples. The static zinc hydrosulfite bleached sample was protected against bacteria for the entire four week period whereas the other samples showed bacteria counts; for example, the agitated samples showed bacteria counts over one million after two weeks. The static K-brite bleached sample showed high bacteria counts at the end of the four week test.

The results of Example 9 show that bleaching a slurry of magnetically brightened clay while the slurry is dispersed provides further brightness enhancement and may be utilized in lieu of, or to supplement, multiple pass purification of the high-solids suspension through the wet magnetic separator.

An interesting phenomenon was noted with respect to control samples which were not bleached but were treated by the wet magnetic separation and then sent to storage. After a time, a brightness increase of about 0.6 GE was noted for the unbleached stored high-solids clay suspension. The brightness improvement was about the same both for biocide treated and non-biocide treated control samples. Bacteria counts for the non-biocide treated suspensions were high but stable and the biocide treated suspension was protected against bacteria for the entire six and one-half week duration of the test.

The present invention is applicable to the treatment of a wide variety of clay materials which contain magnetically removable impurities. For example, the process can be applied to domestic and foreign clay crudes of the soft and hard types. The treatment also can be utilized with mechanically delaminated kaolins. For example, a crude clay or a fraction of a clay crude containing particles amenable to mechanical delamination can be mechanically delaminated before or after charging the material to the magnet. It is also within the scope of the invention to include processing steps other then blunging, optional fractionation, optional delamination, magnetic treatment, and optional bleaching with a hydrosulfite. By way of example, the clay can be subjected, while in the form of a high solids system, to mechanical work in excess of that required for effective blunging. The mechanical work may be used to achieve at least one of the following benefits: viscosity reduction; increase in the liberation of impurities to facilitate degritting, fractionation, magnetic treatment, increase in the yield of a desired fine size fraction of clay, or change in the particle size distribution of clay fractionated to a predetermined cut point. It is also within the scope of the invention to subject the clay to the action of oxidizing agent such as ozone at any stage during processing of the high solids clay water system.

As mentioned above, a particle size fractionation step is included in the process of the invention in those cases in which it is desired to recover a fine particle size fraction of a crude clay. Fractionation can be carried out before or after magnet treatment. For reason of economy, we presently prefer to fractionate the clay before magnetic treatment rather than to fractionate after magnetic treatment.

With regard to the capability of the process to provide fine fractions having commercially useful particle size distributions, products having the following typical particle size characteristics were obtained when degritted slurries were fractionated at representative high solids levels of about 68%, using the preferred combination of alkali and polyacrylate salt in amounts such as to establish an overdispersed slurry, as described in the foregoing illustrative examples. When fractionation was carried out to produce a typical No. 2 coating grade (about 80% by weight finer than 2 microns) 97% by weight was finer then 10 microns and 94% was finer than 5 microns). When crudes were fractionated to produce a No. 1 grade coating clay, 99% was −10 microns, 97% was −5 microns and 90% was −2 microns. Particle sizes were determined by a Sedigraph® 5000 particle size analyzer.

In the illustrative examples, the polyacrylate dispersant that was used was supplied under the trade designation MAYOSPERSE 132E, which is reported by the supplier to have an approximately molecular of 3,400; the polymer has bimodal molecular weight distribution.

Having thus generally described the novel concepts of the invention and specifically described particular embodiments thereof, it is to be understood that no undue restrictions are to be imposed by reason thereof except as defined by the following claims:

What is claimed is:

1. A method for processing impure crude kaolin clay including separating magnetically attractable impurities therefrom, which comprises: (a) blunging crude kaolin in water to form a slurry; (b) removing grit from said slurry; (c) fractionating said slurry to recover one or more fractions of fine clay having a desired particle size, at least step (c), being carried out in the presence of a clay dispersant and steps (a), (b) and (c), being carried out with a clay slurry having a solids content above 50%; (d) charging the dispersed slurry from step (c) to a high gradient wet magnetic separator being operated in a plurality of cycles, each cycle comprising;

(i) passing said slurry containing said impurities upwardly through the said separator while applying a magnetic field to the matrix;

(ii) discontinuing the passage of said slurry through said matrix and thereafter passing pressurized gas downwardly through the matrix to displace retained slurry therefrom, while continuing to apply the magnetic field to said matrix;

(iii) recovering the displaced slurry from step ii;

(iv) deenergizing the magnetic field and flushing said matrix with a flush liquid by at least initially passing the flush liquid upwardly through the matrix, to remove magnetically attractable impurities collected in the matrix;

(v) after flushing the matrix in step iv and prior to repeating the cycle, passing pressurized gas downwardly through the matrix to displace retained flush liquid therefrom, and (e) recovering a slurry of magnetically purified clay at a clay solids level of at least 50%.

2. The process of claim 1 in which the clay slurry has a solids level in the range of about 65 to 70% during all treatment steps except for step (d) in which the slurry has solids content of at least 55%.

3. The process of claim 2 in which the slurry has a solids content of at least 60% during all treatment steps.

4. The process of claim 1 wherein the flush liquid in step (d) is water.

5. The process of claim 1 in which the slurry charged to the magnetic separator in step (d) is overdispersed.

6. The process of claim 5 in which the dispersant comprises sodium hydroxide and sodium polyacrylate.

7. The process of claim 1 wherein a phosphate dispersant is not present during any processing step.

8. The process of claim 1 in which the pH of the slurry during steps (a), (b), (c) and (d) is between about 6 and 7.

9. The process of claim 1 in which the magnetically purified slurry from step (e) is spray dried.

10. The process of claim 1 in which sufficient dry kaolin clay is mixed with the magnetically purified clay slurry from step (d) to form a slurry having a solids content of 70% or higher.

11. The process of claim 1 in which the blunged clay slurry is a solids level of above 70% and is maintained at a solid level as high as is feasible in all steps to assure that the slurry is adequately fluid for the step, and dilution of the clay slurry with water is minimized during all steps.

12. The process of claim 1 including the additional step (f) of bleaching the magnetically purified clay from step (e) without prior flocculation and filtration of the magnetically purified slurry and without flocculation and filtration after bleaching, and spray drying the bleached slurry.

13. The process of claim 1 wherein the recovered displace slurry from step iii is mixed with slurry of impure clay in step (d), whereby a portion of the magnetically purified product is recycled throughout the process.

14. The process of claim 1 wherein the said gas is air.

15. The process of claim 1 in which said gas is applied as a continuous nonpulsating stream.

16. The process of claim 12 in which said air is applied as a continuous nonpulsating stream.

17. The process of claim 1 in which the slurry of magnetically purified clay has a solid content of at least 55%.

18. A method for treating kaolin clay by separating therefrom magnetically attractable impurities in the clay, comprising:

(a) forming a aqueous slurry of the clay in water;

(b) maintaining the slurry at all times during treatment of the clay at 50% or higher solids; and (c) effecting wet magnetic separation of magnetically attractable impurities from the slurry, the wet magnetic separation being carried out in a plurality of cycles, each cycle comprising the steps of (i) passing the slurry containing such particles upwardly through a porous, ferromagnetic matrix contained in a canister while applying a magnetic field to the matrix, (ii) discontinuing the passing of the suspension through the matrix and thereafter passing a pressurized gas downwardly through the matrix to displace retained suspension therefrom, all while continuing to apply the magnetic field to the matrix, (iii) recovering the displaced slurry obtained from step (ii), (iv) after step (iii) deenergizing the magnetic field and in its absence flushing the matrix with a flush liquid to remove magnetically attractable impurities collected therein, and (v) after flushing the matrix in step (iv) and prior to repeating the cycle, passing a pressurized gas downwardly through the matrix to displace retained flush liquid therefrom.

19. The method of claim 18 including carrying out initial wet processing steps of blunging, and degritting the slurry at 55% or higher solids, and introducing the slurry at 55% or higher solids to the wet magnetic separation cycle.

20. The method of claim 18 including maintaining the slurry at all times during treatment of the clay at a solids level of from about 55% to abut 72%.

21. The method of claim 18 in the flush liquid is water and the pressurized gas is air.

22. The method of claim 18 wherein the pressurized gas comprises air at a pressure of from about 8 to 18 psig.

23. The method of claim 18 wherein the pressurized gas is at a pressure of from about 10 to 15 psig.

24. The method of claim 18 wherein the pressurized gas is at a pressure of about 13 psig.

25. The method of claim 18 wherein the intensity of the magnetic field applied to the matrix is from about 5 to 30 kilogauss.

26. The method of claim 18 wherein the intensity of the magnetic field is from about 8.5 to 20 kilogauss.

27. The method of claim 18 wherein the intensity of the magnetic field is about 16 kilogauss.

28. The method of claim 18 wherein the air is at a pressure of from about 10 to 16 psig and the intensity of the magnetic field applied to the matrix is from about 8.5 to 20 kilogauss.

* * * * *